US010900698B2

(12) United States Patent
Saboy

(10) Patent No.: US 10,900,698 B2
(45) Date of Patent: Jan. 26, 2021

(54) METHOD FOR OPERATING A REFRIGERATION UNIT

(71) Applicant: BITZER Kuehlmaschinenbau GmbH, Sindelfingen (DE)

(72) Inventor: Manuel Saboy, Bodman-Ludwigshafen (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 597 days.

(21) Appl. No.: 15/438,003

(22) Filed: Feb. 21, 2017

(65) Prior Publication Data

US 2017/0159984 A1 Jun. 8, 2017

Related U.S. Application Data

(63) Continuation of application No. PCT/EP2015/069075, filed on Aug. 19, 2015.

(30) Foreign Application Priority Data

Aug. 21, 2014 (DE) ..... 10 2014 111 946

(51) Int. Cl.
*F25B 49/02* (2006.01)

(52) U.S. Cl.
CPC ..... *F25B 49/022* (2013.01); *F25B 2400/06* (2013.01); *F25B 2400/075* (2013.01);
(Continued)

(58) Field of Classification Search
CPC ..... F25B 49/022; F25B 2600/02; F25B 2400/06; F25B 2600/0251; F25B 2400/075; F25B 2700/2117; F25B 2700/197
See application file for complete search history.

(56) References Cited

U.S. PATENT DOCUMENTS 4,634,046 A 1/1987 Tanaka
4,725,001 A * 2/1988 Carney ..... G05D 23/1917 236/11

(Continued)

FOREIGN PATENT DOCUMENTS

DE 3516304 A1 11/1985
DE 102014111946 A1 * 2/2016 ..... F25B 49/022
EP 0 899 135 A2 3/1999

*Primary Examiner* — Ljiljana V. Ciric
(74) *Attorney, Agent, or Firm* — Reinhart Boerner Van Deuren P.C.

(57) ABSTRACT

A method for operating a refrigeration unit that includes controlling overall compressor output of the refrigeration unit having at least one state variable. The method includes operating the compressor unit either in a first mode with a first overall compressor output in which the state variable decreases or in a second mode with a second overall compressor output in which the state variable increases, wherein the first and second modes alternate. The method further includes transitioning from the second mode to the first mode when the measured state variable reaches or exceeds a first threshold, and transitioning from the first mode to the second mode when the measured state variable reaches or falls below a second threshold. The difference between the first value and the second value corresponds to the greatest of the state variable differences that result over the respective minimum duration in the first or second mode.

15 Claims, 11 Drawing Sheets

(52) U.S. Cl.
CPC ... *F25B 2600/02* (2013.01); *F25B 2600/0251* (2013.01); *F25B 2700/197* (2013.01); *F25B 2700/2117* (2013.01)

(56) References Cited

U.S. PATENT DOCUMENTS

| | | | | |
|---|---|---|---|---|
| 4,893,480 | A * | 1/1990 | Matsui | B60H 1/3205 62/225 |
| 5,131,237 | A * | 7/1992 | Valbjorn | F25B 5/02 62/175 |
| 5,502,970 | A * | 4/1996 | Rajendran | F25B 41/062 62/115 |
| 5,979,167 | A * | 11/1999 | Kochavi | F24F 3/044 62/186 |
| 5,992,163 | A | 11/1999 | Baruschke et al. | |
| 10,161,649 | B2 * | 12/2018 | Raghunathan | B60H 1/00821 |
| 10,684,052 | B2 * | 6/2020 | Walser | F25B 49/005 |
| 10,704,818 | B2 * | 7/2020 | Nelson | B60H 1/00428 |
| 10,712,066 | B2 * | 7/2020 | Miyakoshi | F25B 49/022 |
| 2001/0049943 | A1 * | 12/2001 | Nakamura | B60H 1/3207 62/176.6 |
| 2004/0016254 | A1 | 1/2004 | Park | |
| 2004/0098994 | A1 | 5/2004 | Lee | |
| 2006/0156748 | A1 | 7/2006 | Lee et al. | |
| 2007/0209376 | A1 * | 9/2007 | Boer | F25D 21/006 62/155 |
| 2011/0144807 | A1 * | 6/2011 | Buda | F25B 49/005 700/275 |
| 2013/0025304 | A1 | 1/2013 | Dorman | |
| 2014/0260385 | A1 * | 9/2014 | Umeda | F25B 1/053 62/180 |
| 2014/0260388 | A1 * | 9/2014 | Umeda | F25B 41/043 62/208 |
| 2014/0303805 | A1 * | 10/2014 | Zhou | F04C 28/08 700/300 |
| 2016/0061504 | A1 * | 3/2016 | Penn, II | F25B 47/025 62/80 |
| 2016/0061507 | A1 * | 3/2016 | Penn, II | H02P 29/024 318/461 |
| 2016/0183408 | A1 * | 6/2016 | Sutherland | F25B 49/02 62/93 |
| 2017/0343230 | A1 * | 11/2017 | Popli | F24F 11/85 |

* cited by examiner

METHOD FOR OPERATING A REFRIGERATION UNIT

CROSS-REFERENCE TO RELATED PATENT APPLICATIONS

This application is a continuation of International application number PCT/EP2015/069075 filed on Aug. 19, 2015.

This patent application claims the benefit of International application No. PCT/EP2015/069075 of Aug. 19, 2015 and German application No. 10 2014 111 946.0 of Aug. 21, 2014, the teachings and disclosure of which are hereby incorporated in their entirety by reference thereto.

BACKGROUND OF THE INVENTION

The invention relates to a method for operating a refrigeration unit, including a circuit that guides a refrigerant and in which the refrigerant is compressed by at least one compressor unit, the compressed refrigerant is cooled by a heat exchanger on the high pressure side, and the cooled compressed refrigerant is expanded by an expansion member and, in a downstream heat exchanger, takes up heat, wherein for the purpose of controlling overall compressor output of the refrigeration unit at least one state variable is measured in a system that includes the refrigeration unit and a medium that interacts with the heat exchanger on the high pressure side and a medium that interacts with the heat exchanger on the low pressure side.

In refrigeration units of this kind, the object is to operate the refrigeration unit with the minimum possible fluctuations in the state variable and with the overall compressor output adapted in optimised manner to the conditions in the system.

SUMMARY OF THE INVENTION

This object is achieved according to the invention with a method of the type mentioned in the introduction in that, in accordance with this at least one state variable, the compressor unit is operated either in a first mode with a first overall compressor output in which the state variable decreases or in a second mode with a second overall compressor output in which the state variable increases, wherein the first and second modes directly succeed one another alternately, in that a transition from the second mode to the first mode is performed when the measured state variable reaches or exceeds a first value, in that a transition from the first mode to the second mode is performed when the measured state variable reaches or falls below a second value, and in that a difference between the first value and the second value corresponds to at least the greatest of the state variable differences that result over the respective minimum duration in the first mode and in the second mode.

The advantage of the solution according to the invention can be seen in the fact that it provides the possibility of selecting the difference between the first value and the second value such that it corresponds to the greatest of the state variable differences in the first mode and in the second mode and thus the refrigeration unit is always operated such that both modes are performed over a duration corresponding to or greater than the minimum duration, with the result that optimum operation of the refrigeration unit is possible.

In the solution according to the invention, it is not established whether the first overall compressor output is greater than the second overall compressor output or the second overall compressor output is greater than the first overall compressor output.

In principle, the first value and the second value could vary, in which case a target value could lie for example between the first value and the second value.

However, a particularly favourable solution provides for the first value or the second value to correspond to an established target value that does not vary, while the respectively other value is established such that a difference between the one value and the other value corresponds to the greatest of the state variable differences.

This means that, in this solution, it is assumed that a target value is usually predefined and as far as possible exceeding or falling below the target value is not to occur.

The expression "as far as possible not exceeding or falling below the target value" should be understood here as referring to the vast majority of the first and second modes, for example to at least 80% of the modes, or preferably at least 90% of the modes.

However, depending on the embodiment of the method according to the invention, it is possible to exceed or fall below the target value in individual modes if very rapid changes in the heat input occur, in particular over the minimum duration, which in individual embodiments of the method according to the invention cannot be taken into account within the minimum duration.

In connection with the individual exemplary embodiments above, more detailed statements have not yet been made as regards the minimum durations.

The minimum durations may in theory lie in the range from milliseconds to several seconds.

Thus, an advantageous solution provides for the respective minimum durations to lie in the range from 1 to 10 seconds.

It is even more advantageous for the respective minimum durations to lie in a range from 2 to 8 seconds.

In principle, the minimum duration for the first mode and the minimum duration for the second mode could be of different lengths.

However, in order to enable the method according to the invention to be carried out as simply as possible, it is preferably provided for the minimum durations in both modes to be of the same length.

More detailed statements have not yet been made as regards determining the threshold for the varying value of the transition from one mode to the other.

For example, the threshold could be determined at the most diverse points in time.

One possibility would be to determine the threshold by averaging.

However, in order to enable the variable threshold for the transition from one mode to the other to be determined by the method according to the invention as promptly as possible, it is provided for this threshold to be determined during the other mode that precedes the one mode.

This means that the variable threshold that is relevant for the current mode for the transition from this one mode to the other mode is determined during the preceding other mode, with the result that the threshold is available promptly in the respectively current mode, which continues until the transition to the other mode, in order to keep fluctuations in the regulating range as small as possible.

This means that with this solution there is always adaptation to the prevailing conditions.

In the foregoing explanation of the method according to the invention, it has been established that the differences between the first value and the second value correspond at least to the greatest of the state variable difference occurring over the minimum duration.

However, it has not necessarily been established that the respective mode is always operated over the respective minimum duration.

In principle, the method according to the invention could be carried out such that the modes are operated to the greatest possible extent for a duration that corresponds at least to the minimum duration, wherein the term "to the greatest possible extent" should be understood to mean that this applies for at least 80% of the modes, preferably at least 90% of the modes, but that in the event of particular occurrences, for example sudden changes in the heat input, modes may occur whereof the duration is smaller than the minimum duration.

However, if within the scope of the method according to the invention the minimum duration in the respective mode is to be observed for all modes, it is preferably provided for the first mode always to be performed at least for a duration corresponding to the minimum duration.

Moreover, it is likewise preferably provided in a case of this kind for the second mode always to be performed at least for a duration corresponding to the minimum duration.

As an alternative or in addition to the solutions described above, a further advantageous solution of the method according to the invention provides for the refrigeration unit to have a plurality of compressor units and for the overall compressor output to be controlled by controlling the flow of refrigerant through at least one of the compressor units.

In this case, it may be provided for the flow of refrigerant to be interrupted by a valve.

However, it may also be provided for the flow of refrigerant in the compressor unit to be influenced by acting on the compression itself, for example by suspending the compression function or by bypass lines.

Particularly advantageously, it is within the scope of the solution according to the invention if the overall compressor output is controlled by controlling the flow of refrigerant through a plurality of the compressor units.

For example, it is also conceivable within the scope of the invention for the overall compressor output to be controlled by controlling the compressor output of at least one of the compressor units, while others of the compressor units continuously compress a flow of refrigerant at a constant compressor output or are switched off.

A solution is particularly advantageous in which establishing the number of compressor units that contribute to the overall compressor output in the first mode is determined by the size of the state variable difference over the minimum duration of the first mode.

Further, it is advantageously provided for the number of compressor units that contribute to the overall compressor output in the second mode to be established by the size of the state variable difference over the minimum duration of the second mode.

These solutions provide the possibility of operating each of the modes mandatorily over the minimum duration, with the result that the minimum duration for the respective mode is always observed, irrespective of any events.

Moreover, the question of how the overall compressor output in the respective modes is established has not been discussed in detail.

Within the scope of the solution according to the invention, all that is necessary is for the overall compressor output to result in a decrease in the state variable during the first mode and an increase in the state variable during the second mode, wherein the absolute size of the overall compressor output may in principle be selected freely.

However, if the overall compressor output is too large and/or too small for the respective case, it may result in a broadening of the bandwidth of the regulating range.

For this reason, a further object of the invention is to adapt the overall compressor output to the respective circumstances in optimised manner.

For this purpose, it is provided within the scope of the solution according to the invention for the overall compressor output in the respective mode to be established such that the state variable difference over the minimum duration in the respective mode is as small as possible.

This means that according to the invention the overall compressor output is varied such that in the first mode the decrease that is made to the state variable is as small as possible, and in the second mode the increase that is made to the state variable is as small as possible.

By decreasing the state variable difference in this way by adapting the overall compressor output to the operating conditions of the system, the bandwidth of the regulating range may also be reduced in optimum manner.

In particular, this can be achieved with an advantageous solution in that the number of compressor units that contribute to the overall compressor output in the respective mode is established such that the state variable difference over the minimum duration in the respective mode is as small as possible.

This means that in the first mode the overall compressor output is established such that the decrease in the state variable over the minimum duration is as small as possible.

Further, it is preferably provided for the number of compressor units that contribute to the overall compressor output in the second mode to be established such that the state variable difference over the minimum duration is as small as possible, that is to say that over the minimum duration the state variable undergoes as small a change as possible.

Further features and advantages of the invention form the subject of the description below and the illustrative representation of some exemplary embodiments.

DETAILED DESCRIPTION OF THE INVENTION

Figure 1:
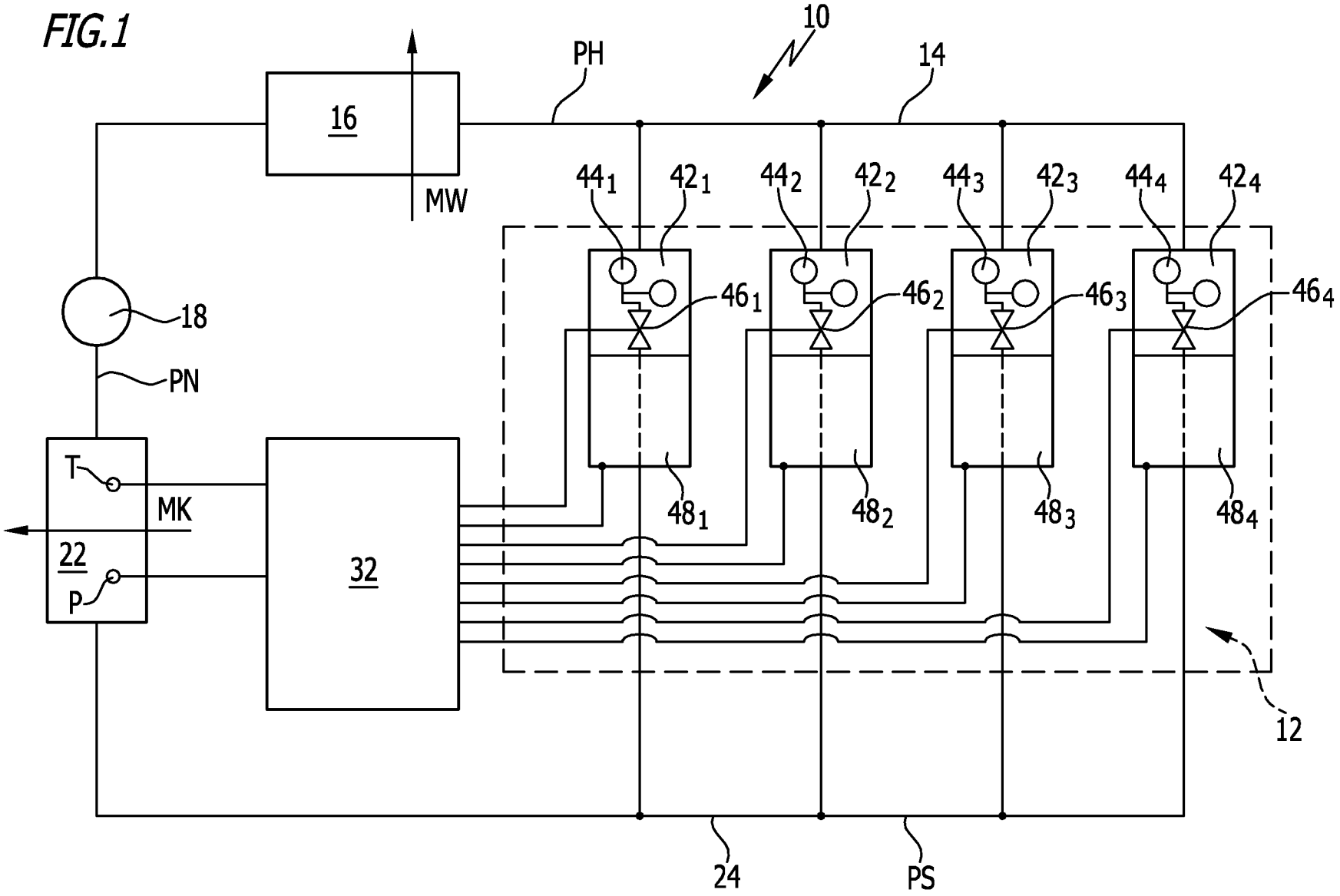
FIG. 1 shows an example of a refrigeration unit, illustrated schematically.

An exemplary embodiment of a refrigeration unit according to the invention, designated 10 as a whole in FIG. 1, includes a compressor unit, designated 12 as a whole, that compresses refrigerant from an intake pressure PS to a high pressure PH.

The refrigerant that has been compressed to high pressure PH is guided by a high pressure collecting line 14 to a heat exchanger 16 on the high pressure side, which removes heat from the refrigerant compressed to high pressure by means of a medium MW flowing through it.

Thereafter, the refrigerant flows to an expansion valve 18 in which expansion from high pressure PH to a low pressure PN takes place, during which this refrigerant that has been expanded to the low pressure PN enters a heat exchanger 22 on the low pressure side and, in the heat exchanger 22 on the low pressure side, is able to take up heat from a medium MK flowing through the latter.

The expanded refrigerant then flows from the heat exchanger 22 on the low pressure side through a collecting line 24 on the low pressure side to the compressor unit 12, and is drawn in at the intake pressure PS.

At any point on the refrigeration unit, or indeed in the medium MW or MK that flows out of the respective heat exchanger 16 or 22, it is possible by measuring a state variable X to determine how powerful the heat input is, and thus to derive the extent to which compressor output is required to keep the state variable X as close as possible to the target value, which is either predefined at a constant level or can vary, in which case this variation has no effect on the target value to be set according to the present solution.

For example, the state variable X is determined in the heat exchanger 22 on the low pressure side.

The compressor output that is required in order to maintain the target value is regulated by a regulating unit 32 that controls the compressor unit 12 such that the compressor output of the compressor unit 12 is adapted to the heat input to the heat exchanger 22 on the low temperature side.

For this purpose, the state variable X or a plurality of state variables X is/are determined, for example at the heat exchanger 22 on the low pressure side, and used to control the compressor output of the compressor unit 12.

State variables X of this kind are for example the temperature T at the heat exchanger 22 on the low pressure side and/or a pressure P of the refrigerant at the heat exchanger 22 on the low pressure side.

These are determined by the regulating unit 32 and result in control of the compressor unit 12 in such a manner that the compressor output thereof is adapted such that the measured state variable X, that is to say for example the temperature T at the heat exchanger 22 on the low pressure side and/or the pressure P at the heat exchanger 22 on the low pressure side, are determined, and the extent to which the compressor unit 12 is partially switched off is established from this/these state variable(s) X.

In the exemplary embodiment according to FIG. 1, the compressor unit 12 includes for example four compressors $\mathbf{42}_1$, $\mathbf{42}_2$, $\mathbf{42}_3$ and $\mathbf{42}_4$, wherein each of these compressors 42 has at least one cylinder unit 44, and each of the cylinder units 44 is uncouplable from the collecting line 24 by a cut-off valve 46 and thus the compressor output thereof is configured to be switched off, with the result that although the drive 48 continues to run the compression of refrigerant can be interrupted by the cut-off valve 46.

However, any type of compressor may be used for the method according to the invention.

As an alternative to providing cut-off valves, however, it is also conceivable to use compressors 42 in which the compressor output can be switched by elements that influence the compression or the guidance of refrigerant.

In this case, each of the cylinder units 44 may include either a single cylinder or a plurality of cylinders, which are, however, configured to be switched off individually or in groups or simultaneously.

The regulating unit 32 controls the compressor output of the individual compressors 42 and the drives 48 of the individual compressors 42 such that in each case, for each state of the heat exchanger 22 on the low pressure side, the appropriate compressor output is available in order to keep conditions in the heat exchanger 22 on the low pressure side as constant as possible.

Functioning of the regulating unit 32 and, on the basis of this, control of the compressor output of the compressor unit 12 are described below.

Operation of the regulating unit 32 according to the invention is explained for example with reference to individual regulating scenarios.

So that the state variable X undergoes as little fluctuation as possible, a regulating range RB for the fluctuations of the state variable X is defined, lying between a first value W1 and a second value W2, with the target value SX lying within the regulating range RB.

In order to obtain as little fluctuation as possible in the state variable X, this regulating range RB is to have as small a bandwidth BB for the state variable X as possible, although the bandwidth BB for the state variable X must have a minimum width in order to enable a minimum switching time to be observed for switching the compressor output, that is to say that if cut-off valves 46 are used the cut-off valves 46 remain in each switching state, that is to say open or closed, over a minimum duration MZ.

The minimum duration MZ for switching the compressor output is for example required in order to ensure suitable trigger times.

To explain operation of the regulating unit 32 of the compressor unit 12 according to FIG. 1, there is taken as an example on the one hand a state in which all the compressors 42 contribute to the overall compressor output, with the result that in particular the cut-off valves $\mathbf{46}_1$ to $\mathbf{46}_4$ of all the compressors 42 are open at the same time, such that the overall compressor output of the compressor unit 12 when all the cut-off valves $\mathbf{46}_1$ to $\mathbf{46}_4$ are opened at the same time corresponds to the maximum compressor output of all the compressors $\mathbf{42}_1$ to $\mathbf{42}_4$, that is to say 100% of the overall compressor output, and on the other hand a state in which half the overall compressor output prevails, that is to say for example with the cut-off valves $46_1$ and $46_2$ closed and thus only cylinder units $48_3$ and $48_4$ still working, that is to say 50% of the maximum compressor output of the compressor unit 12, if in an exemplary solution the assumption is made that the cylinder units $44_1$ to $44_4$ each have the same compressor output.

Taking this scenario as a starting point, in this example the regulating unit 32 has the possibility of variation between 100% of the overall compressor output and 50% of the overall compressor output.

Switching the regulating unit 32 in this way, between 100% of the overall compressor output and 50% of the overall compressor output, is useful for example if the heat input to the heat exchanger 22 on the low pressure side is so great that the state variable X measured for example at the heat exchanger 22 falls at 100% of the overall compressor output but increases at 50% of the compressor output, that is to say that 50% of the overall compressor output is not sufficient to dissipate the quantity of heat input to the heat exchanger unit 22, while the compressor output of 100% dissipates too large a quantity of heat, and so the state variable X cannot be kept constantly at a desired value.

Thus, during a first mode B1, in this example at 100% of the overall compressor output, the state variable X will decrease because the quantity of heat input to the heat exchanger 22 on the low pressure side would only require a lower overall compressor output than 100% to keep the state variable X constant.

However, if the first mode B1 were to persist, it would result in a continuing decrease in the state variable X, so a second mode B2 following the first mode B1 is performed, in which the overall compressor output, for example an overall compressor output of 50%, is small enough for the quantity of heat input to the heat exchanger 22 on the low pressure side to result in an increase in the state variable X.

Because a first mode B1 and a second mode B2 continuously alternate, there is the possibility of keeping the state variable X with fluctuations within the regulating range RB and close to the predefined target value SX.

The fluctuations in the state variable X relative to the target value SX could be reduced if, after each small deviation from the target value SX for the state variable X, there is a changeover from the mode B1 to the mode B2 or from the mode B2 to the mode B1.

However, this would have the consequence that in the exemplary case the overall compressor output would be switched continuously.

However, continuous switching of the overall compressor output of this kind is undesirable, for a multiplicity of reasons.

For this reason, the minimum duration MZ for the respective mode B1 and B2 is introduced, which makes it possible to maintain the switching state of the overall compressor output over the minimum duration MZ, at least in the event of constant or slightly fluctuating heat input to the heat exchanger 22, with the result that the minimum duration MZ establishes the highest possible switching frequency at which the overall compressor output can be switched.

According to the invention, by means of the regulating unit 32 fluctuation of the state variable X is to be minimised, despite the minimum duration MZ predefined for the switching states of the overall compressor output.

This is done in that the regulating unit 32 according to the invention keeps the regulating range RB, which lies between a first value W1 and a second value W2 and within which the state variable X may fluctuate, to as small as possible a bandwidth BB, that is to say as small as possible a spacing between the first value W1 and the second value W2, wherein a changeover from the second mode B2 to the first mode B1 is performed at the first value W1 and a changeover from the first mode B1 to the second mode B2 is performed at the second value W2.

According to the invention, the regulating range RB between the first value W1 and the second value W2 is kept at as small as possible a bandwidth BB, with the bandwidth BB to be dimensioned such that the difference between the first value W1 and the second value W2 corresponds to the greatest change in value in the state variable X that results over the minimum duration MZ in the first mode B1 or in the second mode B2.

This dimensioning of the bandwidth BB applies on the one hand to the ideal case, in which the change in value in the state variable X is of the same size in both modes B1 and B2 over the minimum duration MZ, but also to any other cases in which the change in value in the state variable X is greater in one of the modes B1 or B2 than in the other.

This procedure is based on the consideration that, with the exception of the ideal case, the change in the state variable X over the minimum duration MZ will be greater in one of the two modes B1, B2, that is to say in the first mode B1 or the second mode B2, than in the other, so, with a precondition that both modes, that is to say the mode B1 and the mode B2, are as far as possible always to be operated over the minimum duration MZ, a greater change in the state variable X occurs in one of these modes B1, B2 than in the other, and consequently the bandwidth BB of the regulating range RB has to be adapted to the mode B1, B2 having the greatest change in the state variable X over the minimum duration MZ. In this case, the other mode will prevail over a longer period, as a result of which, however, only the duration for this mode will be longer and thus also the time over which the overall compressor output prevails is longer in this state.

However, this ensures that one of the switching states of the overall compressor output is always present over the minimum duration MZ, with the other of the switching states of the overall compressor output being present for a longer duration.

Keeping the regulating range RB between the first value W1 and the second value W2 can be achieved by the most diverse methods, as described below.

In a first exemplary embodiment of a method, illustrated in FIG. 2 to FIG. 6, the method steps are set up such that the target value SX is as far as possible not to be exceeded, that is to say that the fluctuation in the state variable X is to be only within the range of values of the state variable X that are smaller than the target value SX, with the result that the first value W1 is as far as possible to be at the target value SX and the bandwidth BB of the regulating range RB is adapted largely by varying the second value W2.

This procedure is useful for example for any refrigeration requirements in which the temperature of the heat exchanger 22 on the low pressure side is not to exceed a particular target value SX but in which it is not a critical matter if it falls below the predefined target value SX that is not to be exceeded.

It is possible to establish the variable second value W2 in relation to the first value W1 that is to be kept constant in the most diverse ways.

In the first exemplary embodiment of the method, illustrated by way of example in FIGS. 2 to 6, determining the respective state variable difference ΔXB1 (MZ) or ΔXB2 (MZ) that results in each case over the minimum duration MZ in the respective mode B1 or B2 is performed for example continuously or, depending on the situation, over the duration of the first mode B1 and/or over the duration of the second mode B2.

In the method according to FIGS. 2 to 6 it is assumed that the state variable X decreases with an overall compressor output of for example 100% and increases with a lower overall compressor output of for example 50%.

This applies for example if the state variable X that is measured is the temperature T in the heat exchanger 22.

Further, in the method according to FIGS. 2 to 6 it is assumed that the value W1 is to correspond to the target value SX.

Depending on which of the state variable differences ΔXB1 (MZ) or ΔXB2 (MZ) that results over the minimum duration MZ is the greater, the respectively greater of the state variable differences ΔXB1 (MZ) or ΔXB2 (MZ) serves to set the second value W2 relative to the first value W1 such that the second value W2 lies below the first value W1 by the greatest of the state variable differences ΔXB1 (MZ) or ΔXB2 (MZ).

Figure 2:
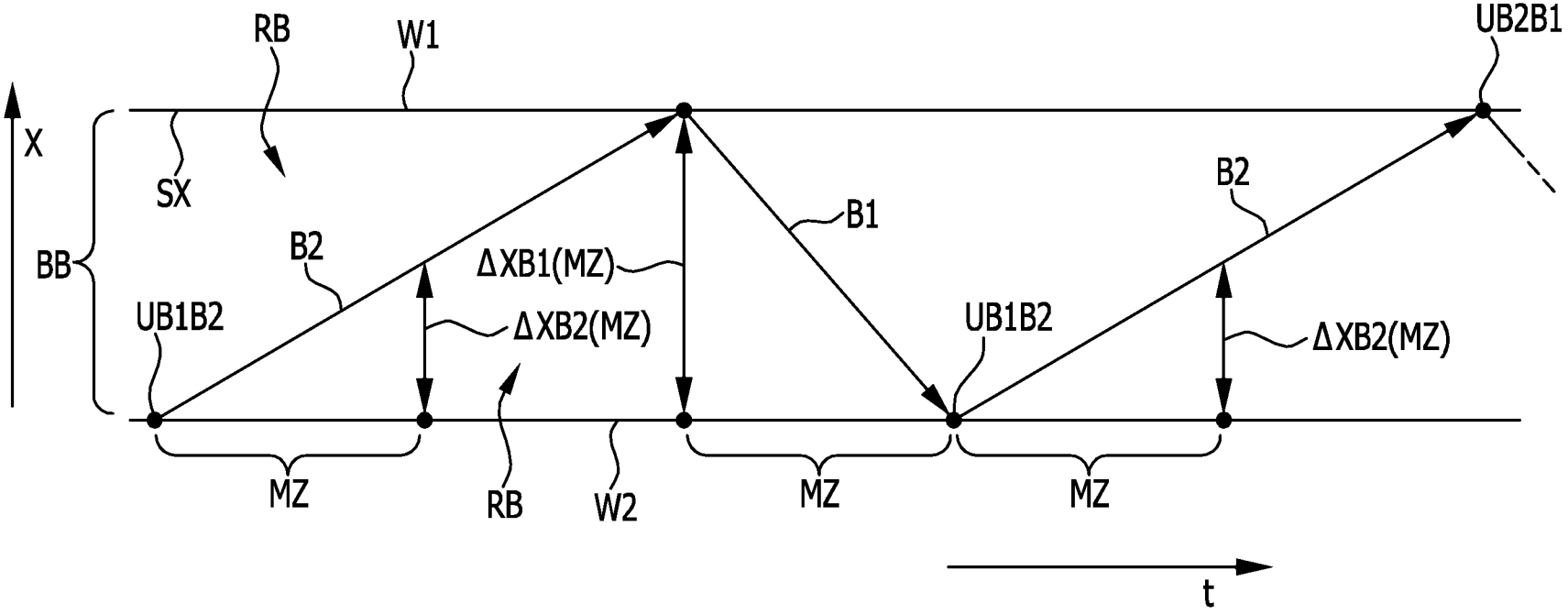
FIG. 2 shows an illustration of the behaviour of the state variable X over time t in a first exemplary embodiment of the method according to the invention, in the case in which the state variable difference over the minimum duration is greater in the first mode than in the second mode.

For example, FIG. 2 shows the course of the state variable X in the two successive modes B1 and B2, wherein the state variable difference ΔXB1 (MZ) over the minimum duration MZ is greater in the mode B1 than the state variable difference ΔXB2 (MZ) over the minimum duration MZ in the mode B2, with the result that the value W2 is determined by the state variable difference ΔXB1 (MZ).

This means that, provided the state variable difference ΔXB1 (MZ) that respectively results over the minimum duration is greater than the state variable difference ΔXB2 (MZ) that respectively results over the minimum duration (MZ), the value W2 in relation to the value W1 is ultimately determined by the state variable difference ΔXB1 (MZ).

Figure 3:
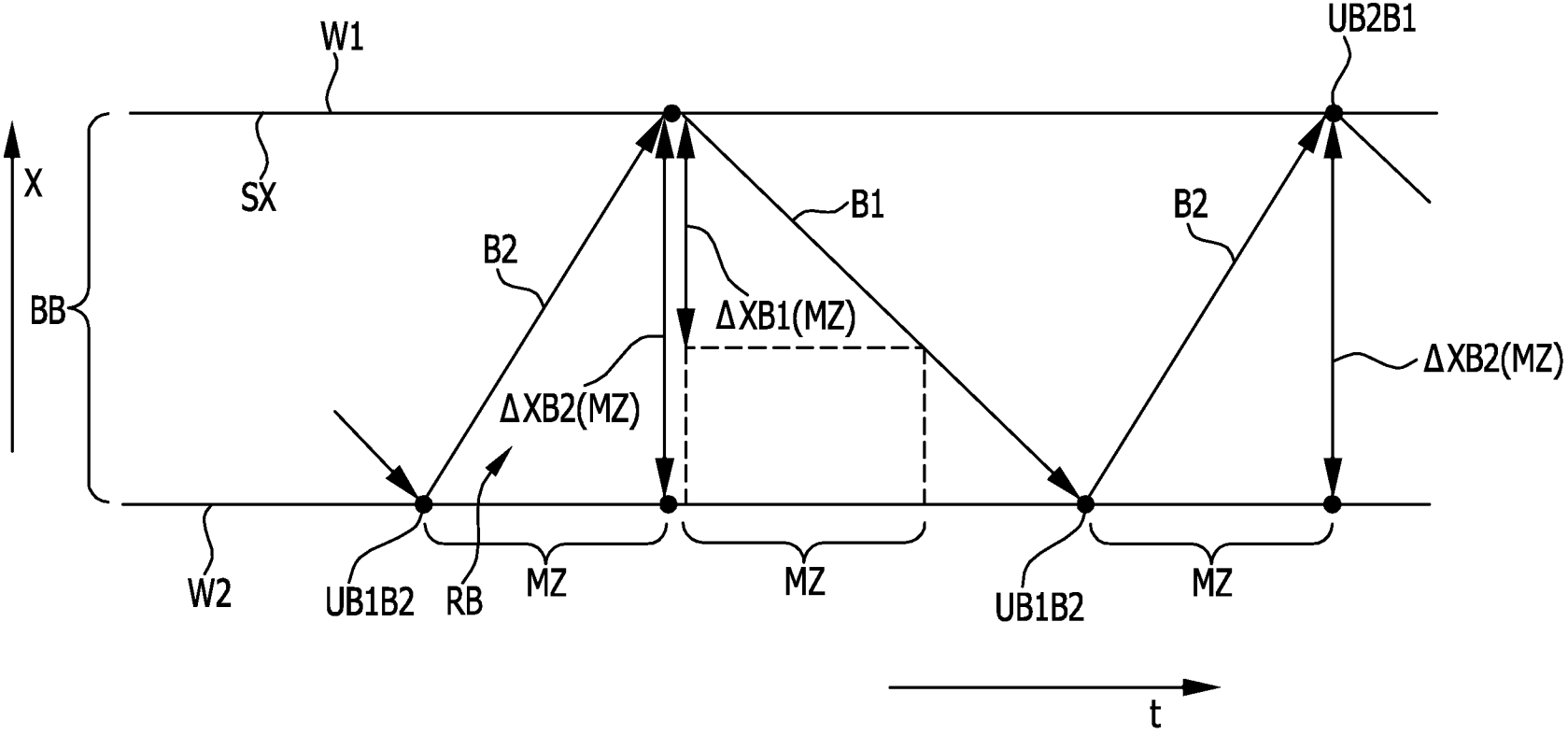
FIG. 3 shows an illustration according to FIG. 2, in the case in which the state variable difference over the minimum duration is smaller in the first mode than in the second mode.

However, if, as illustrated in FIG. 3, the state variable difference ΔXB2 (MZ) that occurs respectively over the minimum duration MZ is greater than the state variable difference ΔXB1 (MZ) that occurs respectively over the minimum duration, then the position of the value W2 is determined by the state variable difference ΔXB2 (MZ).

Figure 4:
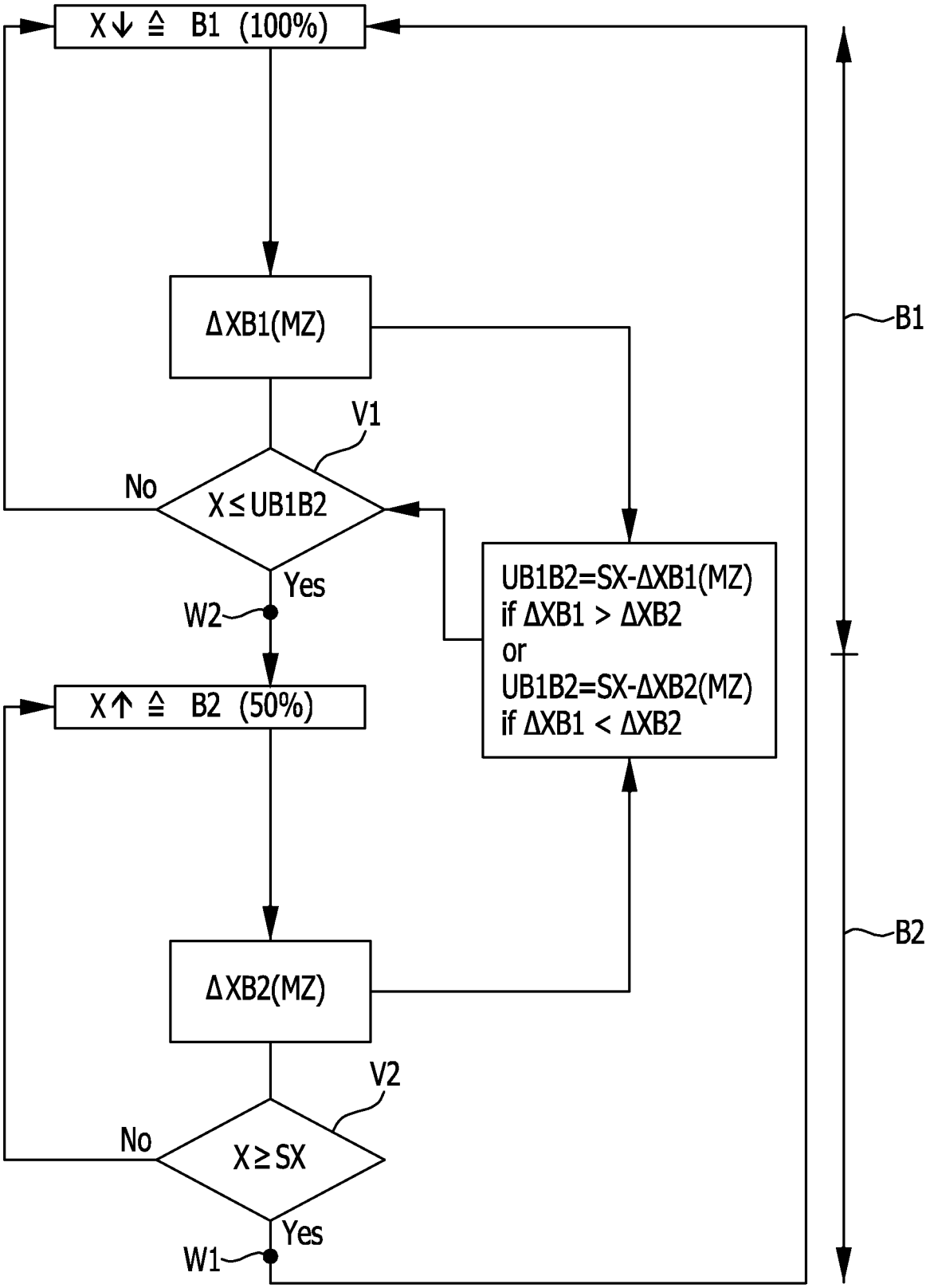
FIG. 4 shows a schematic illustration of a sequence of the first exemplary embodiment of the method according to the invention, which results for example in the course of the state variable X over time t as illustrated in FIGS. 2 and 3.

The determination of the value W2, which in this exemplary embodiment is to have smaller values for the state variable X than the value W1, wherein the target value SX should as far as possible not be exceeded for a prolonged period, is illustrated in a diagram in FIG. 4, with the diagram illustrated in FIG. 4 not necessarily giving an algorithm that has to be observed in order to determine the second value W2 but rather being intended to illustrate the parameters from which the value W2 as illustrated in FIGS. 2 and 3 results.

The diagram according to FIG. 4 provides for the state variable difference ΔXB1 (MZ) during the first mode B1 and the state variable difference ΔXB2 (MZ) during the second mode to be determined and compared.

The greater of the state variable differences ΔXB1 (MZ) or ΔXB2 (MZ) is used according to FIG. 4 to determine the threshold UB1B2, or is to be at a spacing from the target value SX that corresponds to the greater of the state variable differences ΔXB1 (MZ) or ΔXB2 (MZ).

In the method step V1 according to FIG. 4, UB1B2 is therefore used as the threshold which when it is exceeded or fallen below brings about the transition from the first mode B1 to the second mode B2.

In each state, the threshold UB1B2 that is used represents a lower target value of the system for the value W2, which when it is exceeded or fallen below brings about the transition from the first mode B1 to the second mode B2.

Thus, the value W2 is the state variable X in the method step V1.

During the second mode B2, the method step V2 initiates the transition from the second mode B2 to the first mode B1, by comparing the state variable X with the target value SX, which in this exemplary embodiment is predefined at a fixed value, such that exceeding or falling below it brings about the transition from the second mode B2 to the first mode B1 and hence gives the first value W1.

In the procedure, all the modes can be regulated according to the conditions illustrated in FIG. 2 and FIG. 3 in which the changes per unit time are smaller than the state variable differences ΔXB1 (MZ) and ΔXB2 (MZ) over the minimum duration (MZ).

Figure 5:
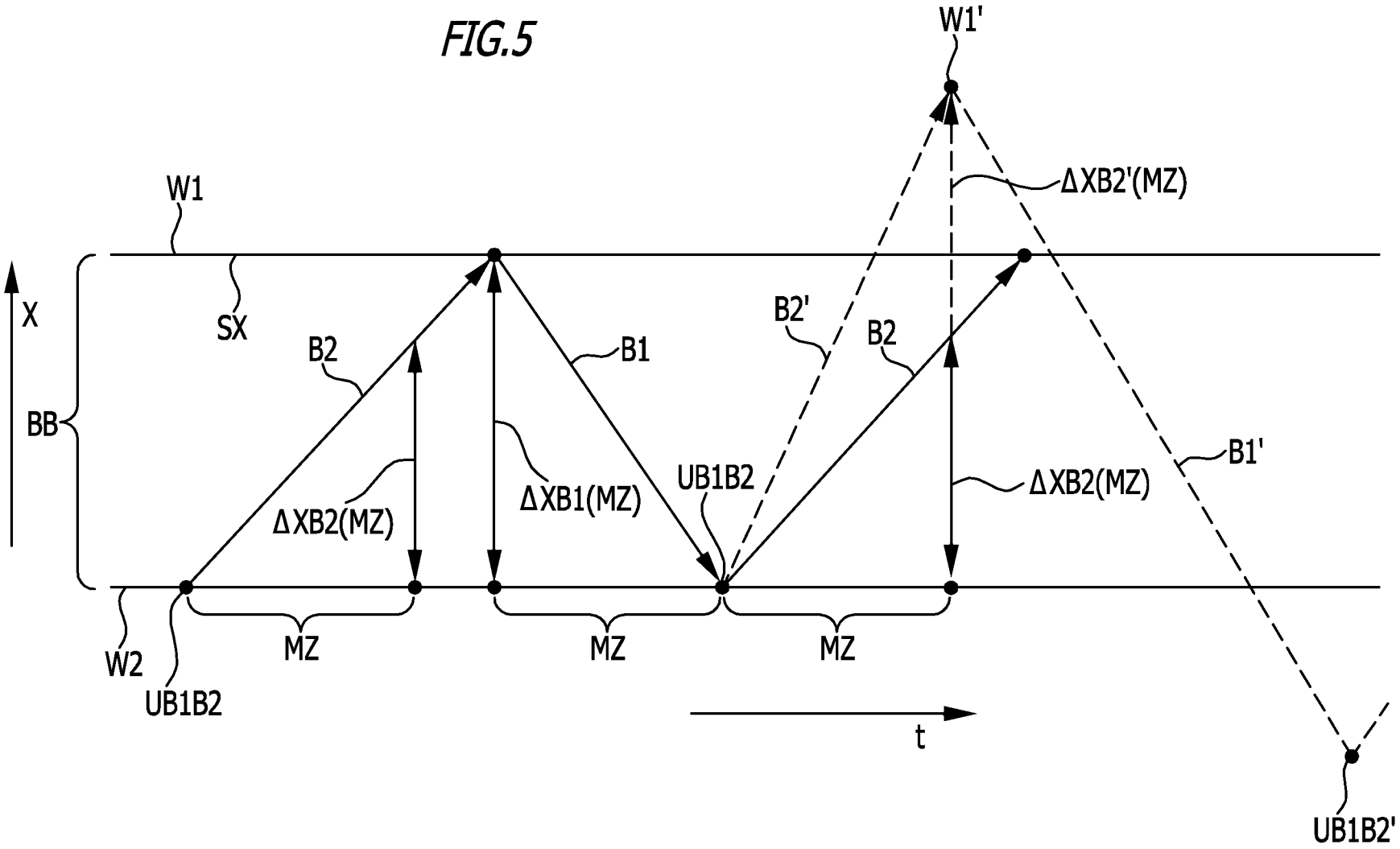
FIG. 5 shows an illustration of the behaviour of the state variable X over time in accordance with FIGS. 2 and 3, in the case of a sudden change in heat input in a first implementation of the first exemplary embodiment of the method according to the invention.

Very sudden changes, in particular sudden additional heat inputs, may result, as illustrated in FIG. 5, in the sudden occurrence of a state variable difference ΔXB2' (MZ) in the mode B2', which unlike the state variable difference ΔXB2 (MZ) before the additional heat input is greater than the state variable difference ΔXB1 (MZ).

In a method according to FIG. 4, this may be managed by two different procedures.

One procedure provides for the mode B2' to be maintained over the minimum duration MZ, as illustrated in dashed lines in FIG. 5, such that, after the minimum duration MZ, because of the state variable difference ΔXB2' (MZ) the state variable X has a value that is above the target value SX, with the result that a changeover at the value W1' from the second mode B2' to the first mode B1 only then takes place, wherein, because the state variable difference ΔXB2' (MZ) was determined during the mode B2', a new value UB1B2' is established that results in the next first mode B1 being performed until the value UB1B2', which is below the target value SX by the amount of the state variable difference ΔXB2' (MZ), has been reached, such that when the second mode B2' is next performed the target value SX is not exceeded again.

This means that, with this procedure, exceeding the target value SX once has an effect until the transition from the mode B2' to the mode B1'.

Figure 6:
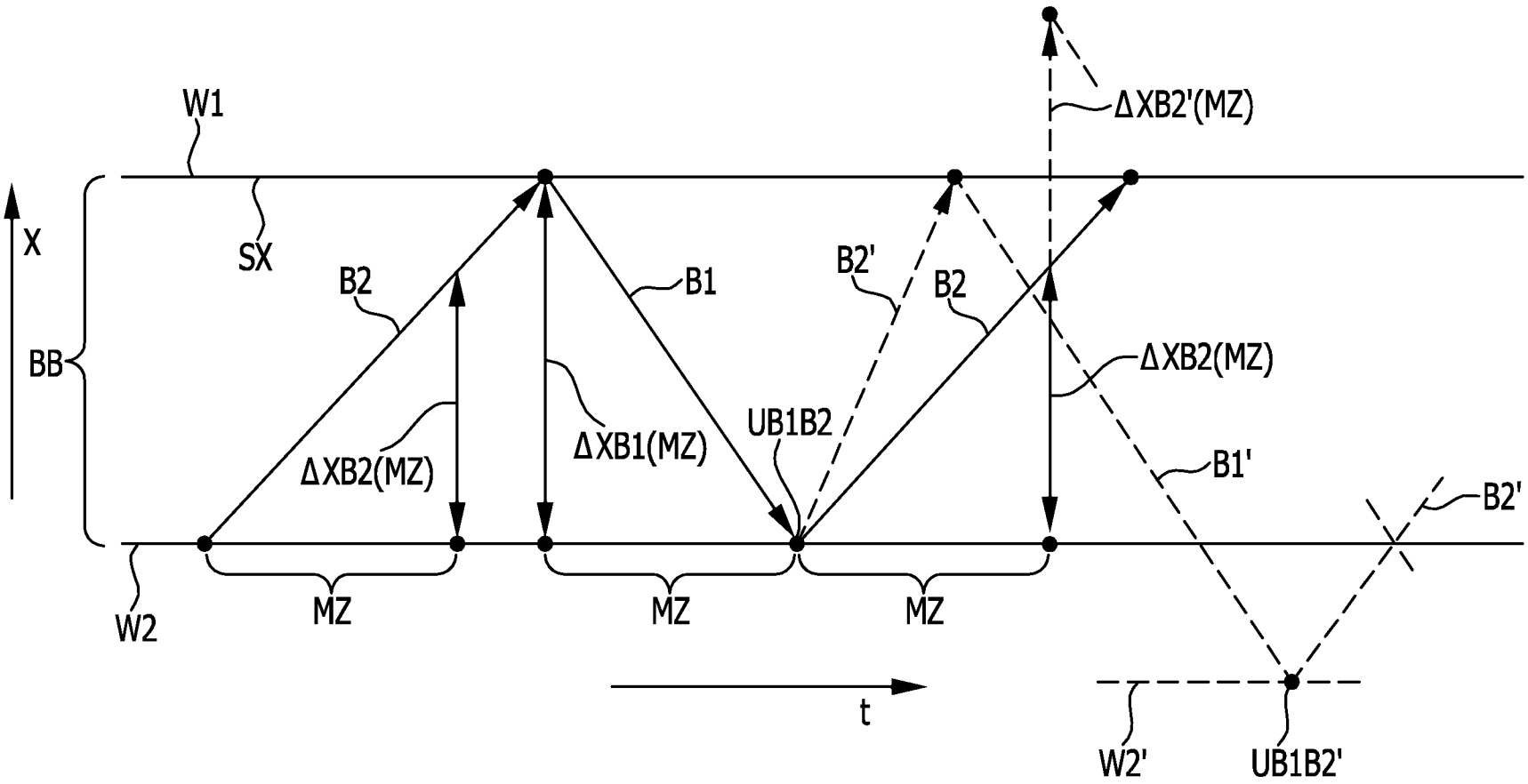
FIG. 6 shows an illustration of the behaviour of the state variable X over time, in a manner similar to FIG. 5, with a suddenly changing heat input in a second implementation of the first exemplary embodiment of the method according to the invention.

As an alternative thereto, however, it is also possible in this case, as illustrated in FIG. 6, for the second mode B2' not to be performed throughout the minimum duration but only until the target value SX—that is to say the value W1—has been reached, and to calculate the value ΔXB2' (MZ) from the period until the target value SX is reached, and then to perform the next first mode B1' until the new, determined value UB1B2', which is below the target value SX by the amount of the state variable difference ΔXB2' (MZ), has been reached, such that subsequently when this value UB1B2' is reached or fallen below, a transition to the second mode B2' can again take place.

In this case, however, the regulating range RB has likewise become so broad that the value W2' at which there is a transition from the first mode B1' to the second mode B2' is located at lower values than the value W2 was before, but in this case the bandwidth between the value W1 and the value W2' again corresponds to the state variable difference ΔXB2' (MZ).

Although the procedure according to FIG. 4 may be the subject of an algorithm that is executed in the regulating unit 32, the algorithm need not necessarily be executed in this form.

Figure 7:
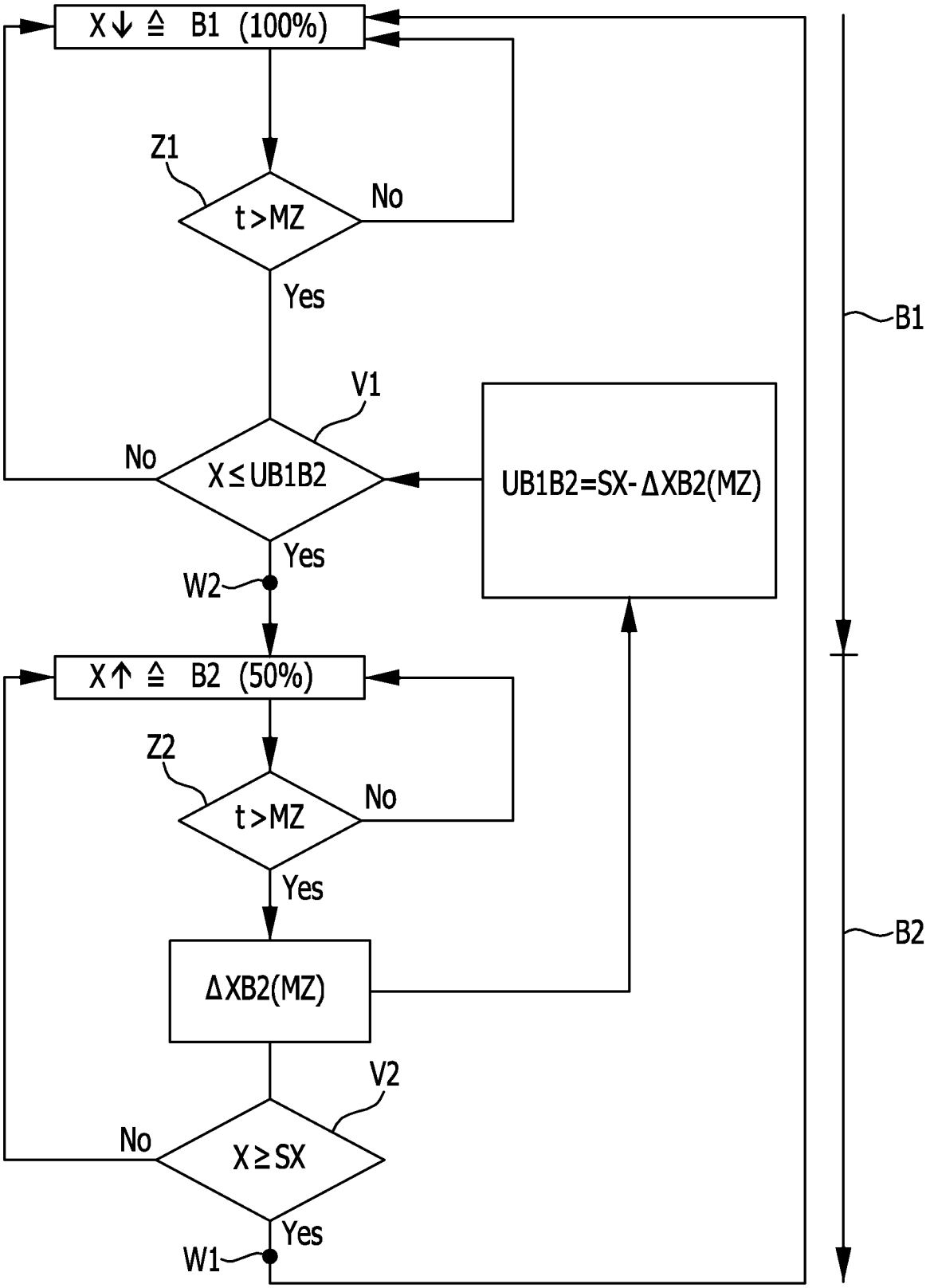
FIG. 7 shows a schematic illustration of a sequence of a second exemplary embodiment of the method according to the invention, in a manner similar to FIG. 4.

For example, the conditions described above with a variable second value W2 in relation to a first target value SX that is kept constant and is not to be exceeded can also be achieved with a second exemplary embodiment of the method, according to FIG. 7.

The method according to FIG. 7 makes the assumption that the state variable X decreases with the overall compressor output of for example 100% and increases with a lower overall compressor output, for example the overall compressor output of 50%.

The method according to FIG. 7 provides a respective method step Z1 and Z2 in the first mode B1 and the second mode B2, and the method step Z1 or Z2 has the result that the respective mode B1, B2 is always maintained over the minimum duration MZ, irrespective of the further method steps.

In this method, according to the method step Z1 the first mode B1 is always performed until the minimum duration MZ has expired.

Thereafter, there follows in the first mode B1 the method step V1, in which the state variable X is compared with a value UB1B2 that was determined in the preceding second mode B2 and that establishes the state variable X at which the second mode B2 is to start, that is to say at which a transition from the first mode B1 to the second mode B2 is to take place.

The value UB1B2 is in this case determined from the state variable difference ΔXB2 (MZ) that results over the minimum duration MZ, and lies below the target value SX by this state variable difference ΔXB2 (MZ).

The method step V1 ensures that the transition from the first mode B1 to the second mode B2 can only take place if the state variable X is equal to or less than the value UB1B2 that is calculated from the value SX less the state variable difference ΔXB2 (MZ).

In this case, the threshold UB1B2 is only relevant to the value W2 that results if the state variable X after the method step Z1 is greater than the threshold UB1B2, since only in this case does the method step V1 have an effect on the value W2, resulting in the first mode B1 being maintained until the condition of the method step Z1 is fulfilled.

If the threshold UB1B2 is greater than the state variable X after the method step Z1, the method step V1 has no effect on the resulting value W2.

In the method according to FIG. 7, in the second mode B2 the method step Z2 is provided, and this ensures that the second mode B2 is maintained at least over the established minimum duration MZ.

Further, the method according to FIG. 7 also provides in the second mode B2 the method step V2, which initiates the transition from the second mode B2 to the first mode B1 if the state variable X is greater than or equal to the fixed target value SX.

In the method according to FIG. 7, a distinction should be made between two cases.

If, in the first case, the state variable difference ΔXB1 (MZ) in the first mode B1 is greater than the state difference ΔXB2 (MZ), then according to the method step Z1 the state variable X corresponds to the value W2.

Although the method step V1 according to FIG. 7 is still carried out after the method step Z1, in the exemplary case it has no relevance to the resulting value W2, since after the method step Z1 the state variable X has values that are lower than the value UB1B2, because the state variable difference ΔXB2 (MZ) is smaller than the state variable difference ΔXB1 (MZ).

In the first case, the result of the method steps Z1 and V1 that are illustrated in FIG. 7 is thus the transition from the first mode B1 to the second mode B2 with the state variable X corresponding to the value W2, wherein the second mode B2 has no effect on the value W2 in this first case.

The subsequent second mode B2 always lasts until the target value SX is reached, and then there is again a transition to the first mode B1.

The course of the state variable X in the procedure according to FIG. 7 in the first case thus corresponds precisely to the course illustrated in FIG. 2.

By contrast, if in a second case the state variable difference ΔXB2 (MZ) is greater than the state variable difference ΔXB1 (MZ), then in the method step Z2 in FIG. 7 the result is that after this step there is a state variable difference ΔXB2 (MZ) that makes it necessary to provide for the method step V1 a threshold UB1B2 lying below the target value SX by ΔXB2 (MZ) if the target value SX is not to be exceeded.

During the first mode B1, the method step Z1 is irrelevant, since the state variable difference ΔXB1 (MZ) results in state variables X that are always greater than the value UB1B2.

Thus, the threshold UB1B2 is used to establish the value W2 at which there is a transition from the first mode B1 to the second mode B2 as a result of the method step V1.

The transition from the second mode B2 to the first mode B1 is subsequently again initiated by the method step V2.

In this case, the course of the state variable X according to FIG. 7 thus corresponds precisely to the course illustrated in FIG. 3.

Figure 8:
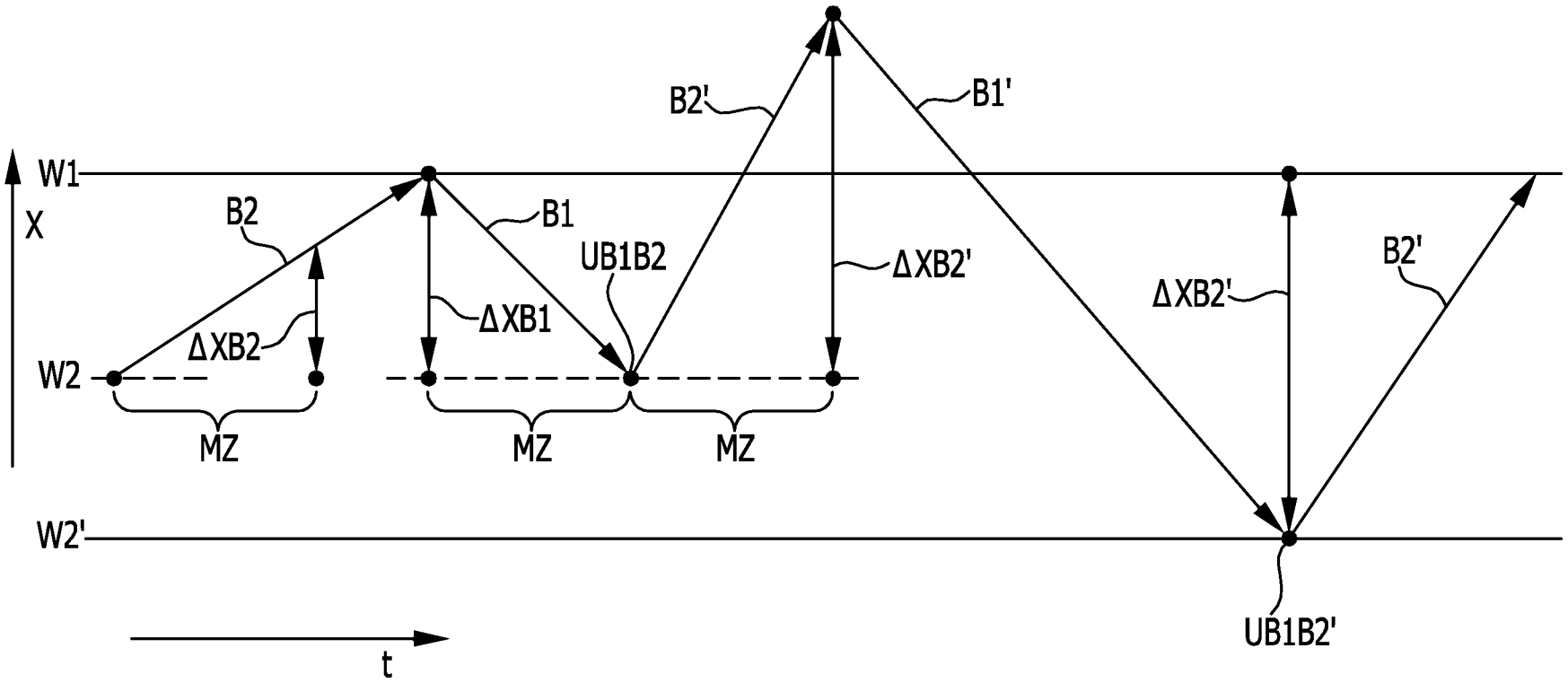
FIG. 8 shows an illustration of behaviour of the state variable X over time t with a sudden heat input in the second exemplary embodiment of the method according to the invention.

If the procedure that is described above with reference to the second exemplary embodiment is maintained according to FIG. 7, that is to say the first modes B1 and B2 are mandatorily performed over the minimum duration MZ, even though for example as a result of external influences that suddenly occur the state variable difference ΔXB2 (MZ) over the minimum duration MZ becomes greater than the state variable difference ΔXB1 (MZ), then in the second mode B2, as illustrated in FIG. 8, the state variable X exceeds the target value SX over the minimum duration MZ, with the result that there is a transition to the first mode B1 at a state variable X that lies significantly above the first target value SX.

In this case, the state variable difference ΔXB2' (MZ) is likewise determined according to FIG. 7 and the second threshold UB1B2' is positioned in relation to the target value SX such that there is a transition from the next first mode B1 to the second mode B2' at the value UB1B2', which is below the target value SX by the amount of the state variable difference ΔXB2' (MZ).

This threshold UB1B2, which results in each case on expiry of a first mode B1 and a subsequent second mode B2, is then used to perform the next first mode B1' until the state variable X reaches or has fallen below the value UB1B2'.

This ensures—provided that the heat input has not changed again—that during the subsequent second mode B2' the first value W1 is not exceeded as a result of a state variable difference ΔXB2 (MZ) over the minimum duration MZ in the second mode B2 that starts from the fixed threshold UB1'B2' and results in the target value SX being exceeded.

In this way, the change in the state variable X once again moves below the target value SX in both modes B1' and B2'.

This is true both for the case in which the state variable difference ΔXB1 (MZ) is greater than the state variable difference ΔXB2 (MZ), as illustrated in FIG. 2, and for the case in which the state variable difference ΔXB1 (MZ) is less than the state variable difference ΔXB2 (MZ), as illustrated in FIG. 3.

Figure 9:
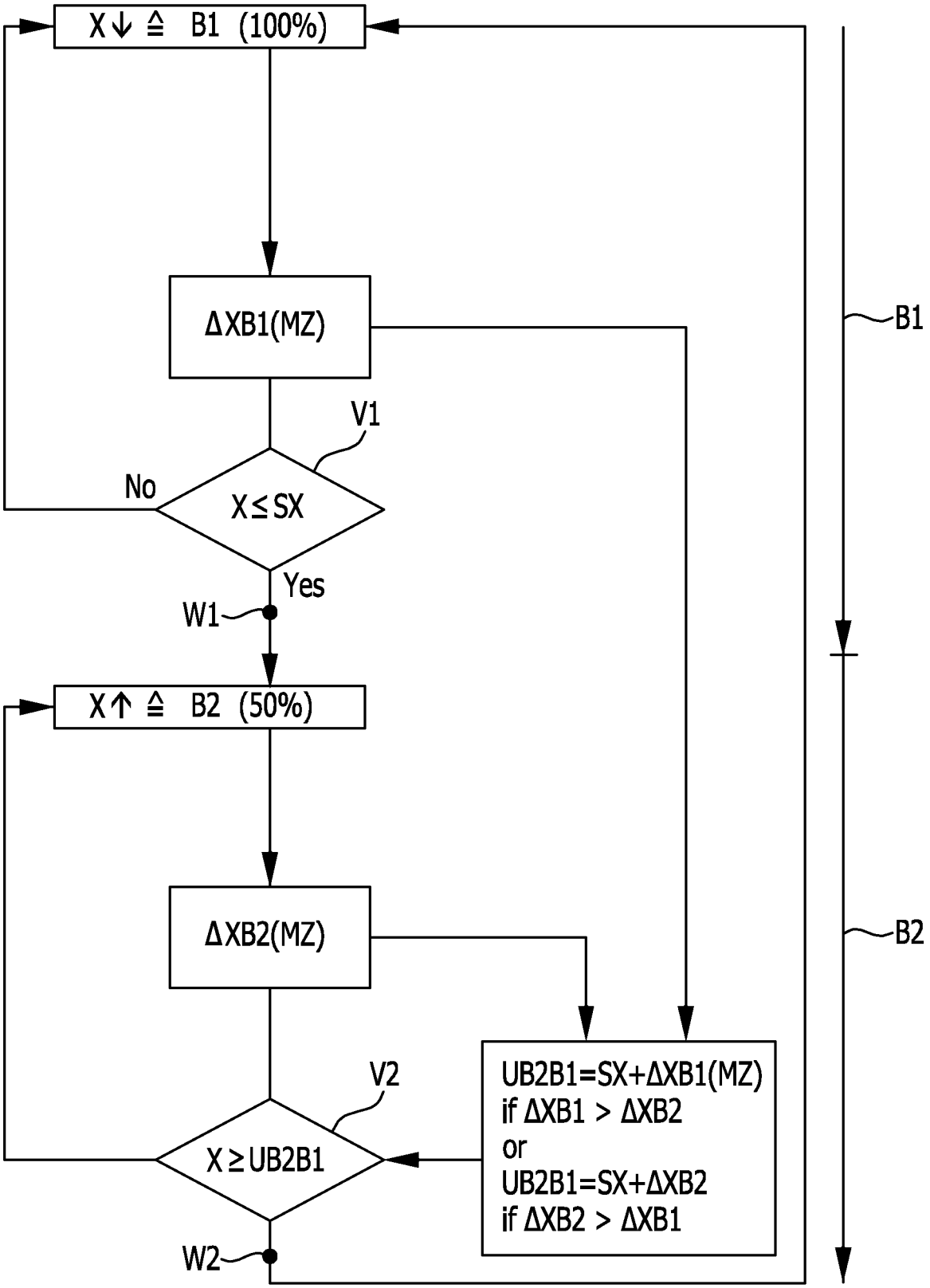
FIG. 9 shows a schematic illustration of a sequence of a third exemplary embodiment of the method according to the invention, in a manner similar to FIG. 4.

As an alternative, however, it is also possible to position the second value W2 close to the target value SX and to allow primarily the first value W1 to vary, as illustrated in FIG. 9 for the third exemplary embodiment, illustrated by way of example, of the method according to the invention.

The method according to FIG. 9 makes the assumption here that the state variable X decreases with an overall compressor output of for example 100% and increases with a lower overall compressor output of for example 50%.

In this case, the first value W1 is positioned variably, depending on which of the state variable differences ΔXB1 (MZ) or ΔXB2 (MZ) is the greater, and the first value W1 lies above the second value W2 by an amount corresponding to the greatest state variable difference ΔXB1 (MZ) or ΔXB2 (MZ).

A third exemplary embodiment that is illustrated by way of example makes the assumption that the regulating unit 32 is operating in an already active condition and there is thus a change to the first mode B1 at the first value W1 of the state variable X.

During the first mode B1, the overall compressor output is for example 100%, with the state variable X decreasing as the duration of time t increases.

During the second mode B2, the overall compressor output is for example 50%, with the state variable X increasing as the duration of time t increases.

In the method according to FIG. 9, the first mode B1 is operated until it is established in the method step V1 that the state variable X is less than or equal to the target value SX. If this is the case, there is a transition to the second mode B2 at the value W1 of the state variable X.

The second mode B2 is also operated until it is established in the method step V2 that the state variable X is greater than or equal to a threshold UB2B1.

This threshold UB2B1 is determined by comparing the state variable difference ΔXB1 (MZ) and the state variable difference ΔXB2 (MZ).

If the state variable difference ΔXB1 (MZ) is greater than the state variable difference ΔXB2 (MZ), the threshold UB2B1 is established such that it corresponds to the target value SX plus the state variable difference ΔXB1 (MZ).

If the state variable difference ΔXB2 (MZ) is greater than the state variable difference ΔXB1 (MZ), the threshold UB2B1 is established such that the threshold UB2B1 corresponds to the target value SX plus the state variable difference ΔXB2 (MZ).

In this way, the transition from the second mode B2 to the first mode B1 is always established in the method step V2 such that it is at a spacing from the target value SX that corresponds to the greatest of the state variable differences ΔXB1 (MZ) or ΔXB2 (MZ), such that the bandwidth BB of the regulating range RB likewise corresponds at least to the greatest of the state variable differences ΔXB1 (MZ) or ΔXB2 (MZ).

In this way, the transition from the second mode B2 to the first mode B1 will always be carried out with state variables X that are equal to or greater than the threshold UB2B1 that has been established according to the procedure explained above.

The method according to FIG. 9 thus proceeds in a manner analogous to the method according to FIG. 4, with the difference that in the method step V1 there is a comparison with the target value SX, unlike the procedure in FIG. 4, and that in the method step V2 there is a comparison with the threshold UB2B1, unlike the method according to FIG. 4, which provides for a comparison with the target value SX in the method step V2.

Taking as a starting point the method according to FIG. 9, it is likewise possible with this method—whereof only the underlying procedure has been described—to implement further variants, analogous to the variants according to FIGS. 5 to 8.

However, the invention also includes the case that the state variable X increases with overall compressor output of 100% and decreases with a lower overall compressor output of for example 50%.

In this case, in a fourth exemplary embodiment, for example the temperature T in the heat exchanger 16 is measured as the state variable X.

Further, in this case for example the lower value W2 is defined as the target value SX'.

Figure 10:
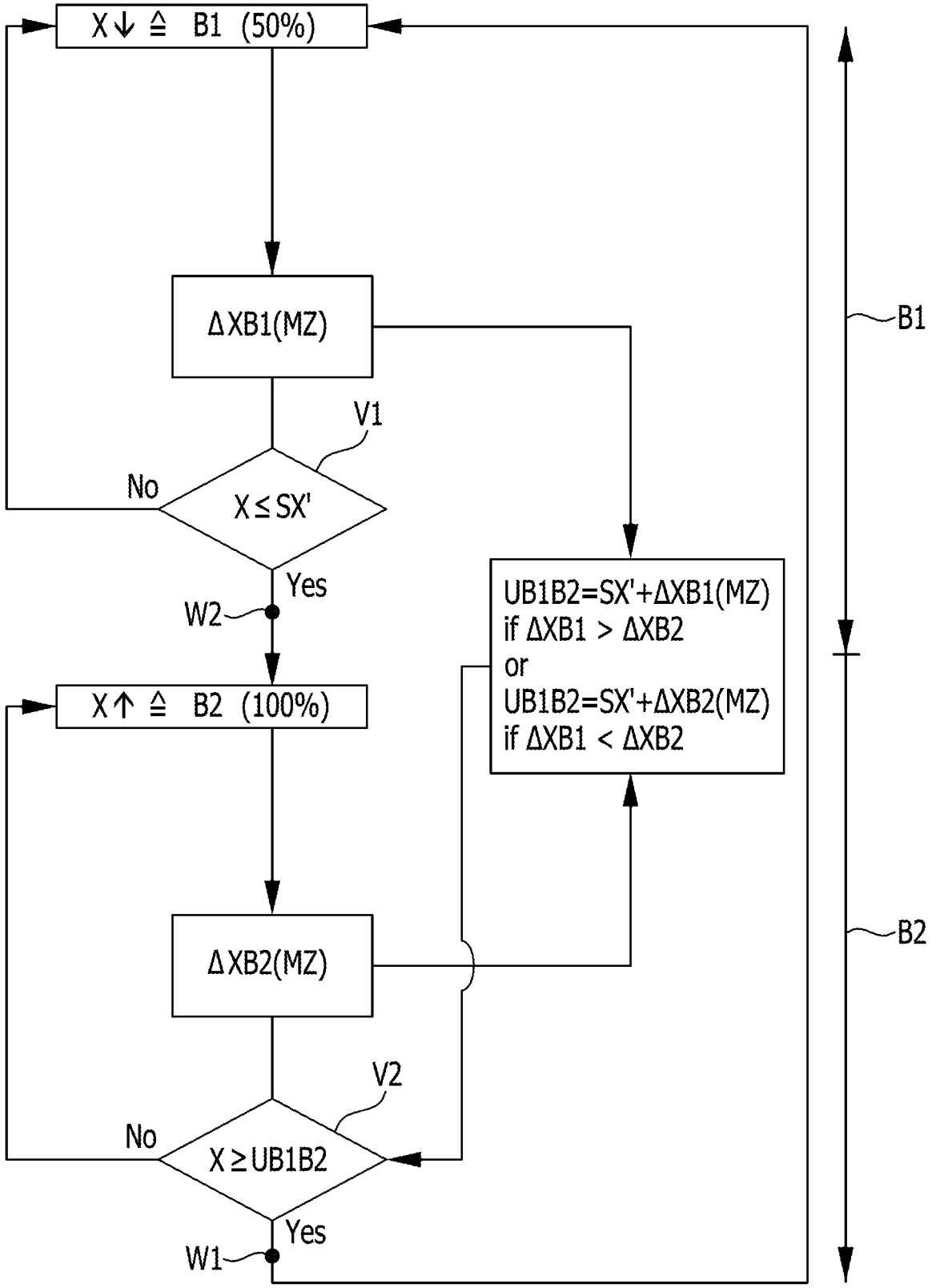
FIG. 10 shows a schematic illustration of a sequence of a fourth exemplary embodiment of the method according to the invention, in a manner similar to FIG. 4.

With these preconditions, the method according to FIG. 4 is not appropriate, but rather the method corresponding to FIG. 4 is to be carried out according to FIG. 10.

Figure 11:
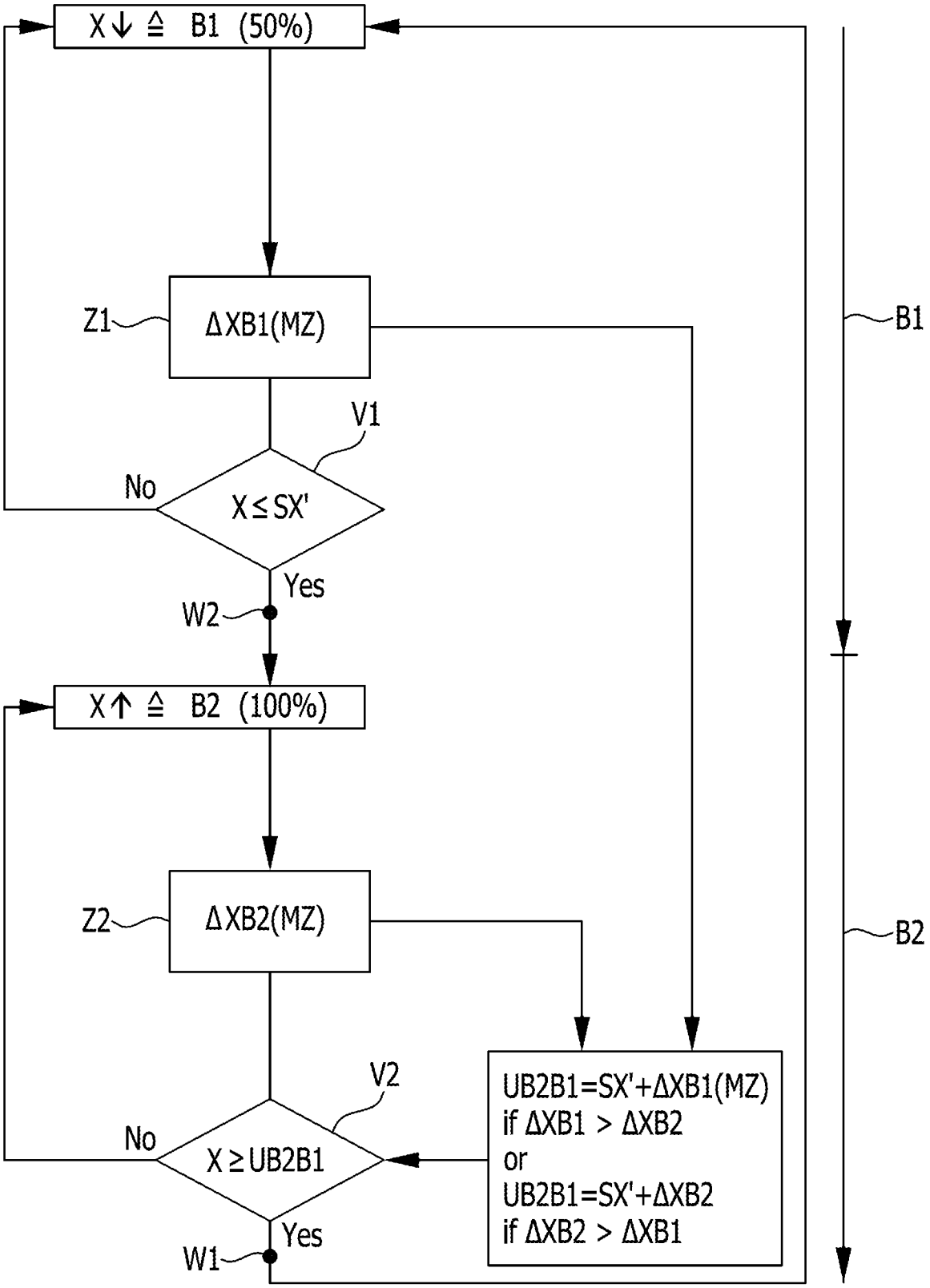
FIG. 11 shows a schematic illustration of a sequence of a fifth exemplary embodiment of the method according to the invention, in a manner similar to FIG. 4.

In like manner, with these preconditions, in a fifth exemplary embodiment a method corresponding to FIG. 9 would need to be carried out according to FIG. 11.

In the context of the exemplary embodiments described hitherto, only operation of the regulating unit 32 between two values of the compressor output, that is for example the value of the overall compressor output at 100% and the value of the overall compressor output at 50%, has been described.

In order, according to the invention, to keep the bandwidth BB of the regulating range RB as small as possible, the overall compressor output is to be adapted in optimised manner to the heat input to the heat exchanger 22 on the low pressure side.

This is done for example in that the regulating unit 32 successively decreases the overall compressor output for the first mode B1 in order to select the state variable difference ΔXB1 (MZ) over the minimum duration MZ such that it is as small as possible.

However, the overall compressor output for the first mode B1 is not permitted to be decreased so much that the state variable X is no longer decreased in the first mode B1.

This means that a stepwise decrease in the overall compressor output is performed by the regulating unit 32 for the first mode B1 while the state variable difference ΔXB1 (MZ) over the minimum duration MZ is still negative, that is to say that a decrease in the state variable X is carried out during the first mode B1.

Moreover, to reduce the bandwidth BB of the regulating range RB, the overall compressor output during the second mode B2 is increased stepwise, but likewise only while the state variable difference ΔXB2 (MZ) over the minimum duration MZ is still positive, that is to say that the state variable X continues to increase during the second mode B2.

These measures of varying the overall compressor output make it possible further to reduce the bandwidth BB of the regulating range RB between the first value W1 and the second value W2.

A procedure for adapting the overall compressor output provides for example that, after a first mode B1 and a next second mode B2 have been run, the state variable differences ΔXB1 (MZ) and ΔXB2 (MZ) after the minimum durations MZ are compared with one another.

If the state variable differences ΔXB1 (MZ) and ΔXB2 (MZ) are very different, then first the overall compressor output is changed for the mode B1, B2 that results in the greatest value of the state variable differences ΔXB1 (MZ), ΔXB2 (MZ).

Here, in the exemplary embodiment according to FIG. 1, the change is made stepwise, in accordance with the steps of overall compressor output that are predefined by the construction of the compressor unit 12 and that are possible with the compressor unit 12 and the cut-off valves $46_1$ to $46_4$.

Here, the stepwise change in the overall compressor output is made until the state variable difference ΔXB1 (MZ), ΔXB2 (MZ) of the respective mode B1, B2 is smaller than that of the other mode B2, B1.

This means for example that if the state variable difference ΔXB1 (MZ) in the first mode B1 is substantially greater than the state variable difference ΔXB2 (MZ) in the second mode B2, a stepwise decrease is made to the overall compressor output for the first mode B1 until the state variable difference ΔXB1 (MZ) in the first mode B1 is less than the state variable difference ΔXB2 (MZ) in the second mode B2.

Then, an increase is made, likewise stepwise, to the overall compressor output in the second mode B2 until the state variable difference ΔXB2 (MZ) in the second mode B2 is again less than the state variable difference ΔXB1 (MZ) in the first mode B1.

Then, a stepwise decrease may be made again to the overall compressor output in the first mode B1 until the state variable difference ΔXB1 (MZ) in the first mode B1 is again less than the state variable difference ΔXB2 (MZ) in the second mode.

This may continue until the overall compressor output in the first mode B1 can no longer be decreased, since otherwise the state variable X in the first mode B1 would no longer decrease, and the overall compressor output in the second mode B2 can no longer be increased, since otherwise the state variable X in the second mode B2 would no longer increase.

In this case, an optimum adaptation of the overall compressor output to the heat input to the heat exchanger 22 on the low pressure side is thus obtained.

The invention claimed is:

1. A method for operating a refrigeration unit, including a circuit that guides a refrigerant and in which the refrigerant is compressed by at least one compressor unit, the method comprising:

cooling the compressed refrigerant with a heat exchanger on the high pressure side;

expanding the cooled compressed refrigerant with an expansion member such that, in a downstream heat exchanger, the cooled compressed refrigerant takes up heat;

for the purpose of controlling overall compressor output of the refrigeration unit, measuring at least one state variable in a system that includes the refrigeration unit and a medium that interacts with the heat exchanger on the high pressure side and a medium that interacts with the heat exchanger on the low pressure side, in accordance with this at least one state variable, operating the compressor unit either in a first mode with a first overall compressor output in which the state variable decreases or in a second mode with a second overall compressor output in which the state variable increases, wherein the first and second modes directly succeed one another alternately;

transitioning from the second mode to the first mode when the measured state variable reaches or exceeds a first threshold; and transitioning from the first mode to the second mode when the measured state variable reaches or falls below a second threshold, and a difference between the first value and the second value corresponds to the greatest of the state variable differences ΔXB1, ΔXB2 that result over a respective minimum duration in the first mode or in the second mode.

2. The method according to claim 1, wherein the first value or the second value corresponds to an established target value that does not vary, while the respectively other value is established such that a difference between the one value of the first values and the second value and the other value of the first value and the second value corresponds to the greatest of the state variable differences.

3. The method according to claim 1, wherein the respective minimum durations in the first mode or second mode lie in a range from 1 to 10 seconds.

4. The method according to claim 3, wherein the respective minimum durations in the first mode or second mode lie in a range from 2 to 8 seconds.

5. The method according to claim 1, wherein the respective minimum durations in the first mode or second mode are of the same length.

6. The method according to claim 1, wherein the variable threshold for the transition from one mode of the first mode and the second mode to the other mode of the first mode and the second mode is determined during the mode that precedes the one mode.

7. The method according to claim 1, wherein the first mode is always performed at least for a duration corresponding to the respective minimum duration in the first mode or second mode.

8. The method according to claim 1, wherein the second mode is always performed at least for a duration corresponding to the respective minimum duration in the first mode or second mode.

9. A method for operating a refrigeration unit, including a circuit that guides a refrigerant and in which the refrigerant is compressed by at least one compressor unit, the method comprising:

cooling the compressed refrigerant with a heat exchanger on the high pressure side;

expanding the cooled compressed refrigerant with an expansion member such that, in a downstream heat exchanger, the cooled compressed refrigerant takes up heat;

for the purpose of controlling overall compressor output of the refrigeration unit, the method further includes:

measuring at least one state variable in a system that includes the refrigeration unit and a medium that interacts with the heat exchanger on the high pressure side and a medium that interacts with the heat exchanger on the low pressure side; and in accordance with this at least one state variable, operating the compressor unit either in a first mode with a first overall compressor output in which the state variable decreases or in a second mode with a second overall compressor output in which the state variable increases, wherein the first and second modes directly succeed one another alternately;

transitioning from the second mode to the first mode when the measured state variable reaches or exceeds a first threshold; and transitioning from the first mode to the second mode when the measured state variable reaches or falls below a second threshold, the refrigeration unit having a plurality of compressor units, the method further comprising controlling the overall compressor output by controlling the flow of refrigerant through at least one of the plurality of compressor units.

10. The method according to claim 9, further comprising controlling the overall compressor output by controlling the flow of refrigerant through more that one of the plurality of compressor units.

11. The method according to claim 9, wherein the overall compressor output is controlled by controlling the compressor output of at least one of the compressor units, while others of the compressor units continuously compress a flow of refrigerant or are switched off.

12. The method according to claim 9, wherein establishing a number of compressor units that contribute to the overall compressor output in a first mode is determined by the size of the state variable difference ΔXB1 over a minimum duration of the first mode.

13. The method according to claim 9, wherein establishing a number of compressor units that contribute to the overall compressor output in a second mode is established by the size of the state variable difference ΔXB2 over a minimum duration of the second mode.

14. A method for operating a refrigeration unit, including a circuit that guides a refrigerant and in which the refrigerant is compressed by at least one compressor unit, the method comprising:

cooling the compressed refrigerant with a heat exchanger on the high pressure side;

expanding the cooled compressed refrigerant with an expansion member such that, in a downstream heat exchanger, the cooled compressed refrigerant takes up heat;

for the purpose of controlling overall compressor output of the refrigeration unit, measuring at least one state variable in a system that includes the refrigeration unit and a medium that interacts with the heat exchanger on the high pressure side and a medium that interacts with the heat exchanger on the low pressure side; and in accordance with this at least one state variable, operating the compressor unit either in a first mode with a first overall compressor output in which the state variable decreases or in a second mode with a second overall compressor output in which the state variable increases, wherein the first and second modes directly succeed one another alternately;

transitioning from the second mode to the first mode when the measured state variable reaches or exceeds a first threshold; and transitioning from the first mode to the second mode when the measured state variable reaches or falls below a second threshold, establishing the overall compressor output in the first and/or second mode such that the state variable difference over a minimum duration in the first and/or second mode is as small as possible.

15. A method for operating a refrigeration unit, including a circuit that guides a refrigerant and in which the refrigerant is compressed by at least one compressor unit, the method comprising:

cooling the compressed refrigerant with a heat exchanger on the high pressure side;

expanding the cooled compressed refrigerant with an expansion member such that, in a downstream heat exchanger, the cooled compressed refrigerant takes up heat;

for the purpose of controlling overall compressor output of the refrigeration unit, measuring at least one state variable in a system that includes the refrigeration unit and a medium that interacts with the heat exchanger on the high pressure side and a medium that interacts with the heat exchanger on the low pressure side; and in accordance with this at least one state variable, operating the compressor unit either in a first mode with a first overall compressor output in which the state variable decreases or in a second mode with a second overall compressor output in which the state variable increases, wherein the first and second modes directly succeed one another alternately;

transitioning from the second mode to the first mode when the measured state variable reaches or exceeds a first threshold; and transitioning from the first mode to the second mode when the measured state variable reaches or falls below a second threshold, establishing the number of compressor units that contribute to the overall compressor output in the first and/or second mode such that the state variable difference over a minimum duration in the first and/or second mode is as small as possible.

* * * * *